US008171905B2

(12) United States Patent
Lee

(10) Patent No.: US 8,171,905 B2
(45) Date of Patent: May 8, 2012

(54) OIL CIRCUIT OF CONTINUOUSLY VARIABLE VALVE TIMING DEVICE

(75) Inventor: Bong Sang Lee, Suwon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 452 days.

(21) Appl. No.: 12/552,141

(22) Filed: Sep. 1, 2009

(65) Prior Publication Data

US 2010/0122679 A1 May 20, 2010

(30) Foreign Application Priority Data

Nov. 18, 2008 (KR) ..... 10-2008-0114792

(51) Int. Cl.
*F01M 1/06* (2006.01)

(52) U.S. Cl. ..... 123/90.33; 123/90.16; 123/90.17; 123/196 R

(58) Field of Classification Search ..... 123/90.33, 123/90.15, 90.16, 90.17, 196 R
See application file for complete search history.

(56) References Cited

U.S. PATENT DOCUMENTS 4,512,298 A * 4/1985 Hayashi ..... 123/196 R

* cited by examiner

*Primary Examiner* — Zelalem Eshete
(74) *Attorney, Agent, or Firm* — Morgan, Lewis & Bockius LLP

(57) ABSTRACT

An oil circuit for a continuously variable valve timing apparatus, may include a main line that is formed in a cylinder block to receive oil from a hydraulic pump, a first oil line that connects an intake oil control valve that is mounted on a cylinder head that is assembled to the cylinder block with the main line, a second oil line that connects an exhaust oil control valve that is mounted in a cylinder head cover with the first oil line, a third oil line that connects a cam journal that is formed in the cylinder head with the first oil line, and a fourth oil line that connects a timing chain tensioner that is mounted in the cylinder block with the third oil line.

11 Claims, 2 Drawing Sheets

OIL CIRCUIT OF CONTINUOUSLY VARIABLE VALVE TIMING DEVICE

CROSS-REFERENCE TO RELATED APPLICATION

The present application claims priority to Korean Patent Application No. 10-2008-0114792 filed on Nov. 18, 2008, the entire contents of which are incorporated herein for all purposes by this reference.

BACKGROUND OF THE INVENTION

1. Field of the Invention

The present invention relates to a continuously variable valve timing apparatus, and more particularly to an oil circuit for a continuously variable valve timing apparatus.

2. Description of Related Art

Generally, a continuously variable valve timing (CVVT) device varies the opening timing of a valve according to driving conditions of an engine.

The continuously variable valve timing apparatus is controlled by hydraulic pressure that is transmitted from a hydraulic pump. For this, oil circuits are configured inside the cylinder block and the cylinder head that are constituent elements of an engine so as to supply the continuously variable valve timing apparatus with the oil.

The oil circuit is adequately formed considering the responsiveness of the continuously variable valve timing apparatus.

The responsiveness of the continuously variable valve timing apparatus can be affected by the supply timing of the oil that is supplied to the constituent elements thereof.

Particularly, in the dual continuously variable valve timing apparatus (D-CVVT) that varies the movements of the intake valve and the exhaust valve as related to the present invention, it is to be controlled that the opening/closing of the intake valve and the exhaust valve is performed with accurate timing.

Accordingly, adequately determination of the oil supply order and the oil supply route of the constituent elements are needed.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an oil circuit of a continuously variable valve timing device that decreases a fluctuation of hydraulic pressure that is supplied to a continuously variable valve timing apparatus to improve responsiveness thereof such that it can be accurately operated, wherein oil of an exhaust side is supplied downwards from a head cover to be a top-down type such that the oil is almost not affected by heat of the engine and a reduction of hydraulic pressure is minimized.

In an aspect of the present invention, the oil circuit for a continuously variable valve timing apparatus, may include a main line that is formed in a cylinder block to receive oil from a hydraulic pump, a first oil line that connects an intake oil control valve that is mounted on a cylinder head that is assembled to the cylinder block with the main line, a second oil line that connects an exhaust oil control valve that is mounted in a cylinder head cover with the first oil line, a third oil line that connects a cam journal that is formed in the cylinder head with the first oil line, and a fourth oil line that connects a timing chain tensioner that is mounted in the cylinder block with the third oil line.

An intake continuously variable valve timing apparatus may be mounted on the cylinder head and receives the oil from the intake oil control valve. The second oil line may be branched from the first oil line in the cylinder head.

The third oil line may be branched from the first oil line in the cylinder block, wherein the fourth oil line is branched from the third line in the cylinder block and wherein a distance between the main line and a branching point of the first and third oil lines is shorter than a distance between the main line and a branching point of the third and fourth oil lines.

In another aspect of the present invention, an exhaust continuously variable valve timing apparatus (exhaust CVVT) that receives the oil from the exhaust oil control valve may be mounted on the cylinder head, and a top-down oil line may be formed therebetween such that the oil is supplied from the exhaust oil control valve to the exhaust continuously variable valve timing apparatus through the second oil line.

A distance between the cam journal and a branching point of the third and fourth oil lines may be shorter than the fourth oil line such that the oil is first supplied to the cam journal ahead of the timing chain tensioner.

In further another aspect of the preset invention, a main bearing may be connected to the main line in the cylinder block.

In various aspects of the present invention, the fluctuation of the hydraulic pressure decreases to secure responsiveness and accurate operation of the continuously variable valve timing apparatus.

Also, the exhaust oil line is configured downward from the head cover such that the decrease of the hydraulic pressure is minimized and the oil is not deteriorated by the heat of the engine.

Also, the oil is first supplied to the cam journal ahead of the timing chain tensioner such that sufficient oil flux can be obtained to securely operate the continuously variable valve timing apparatus.

Accordingly, the camshaft is swiftly interlocked with the crankshaft so as to transmit the driving torque of the crankshaft to the camshaft.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
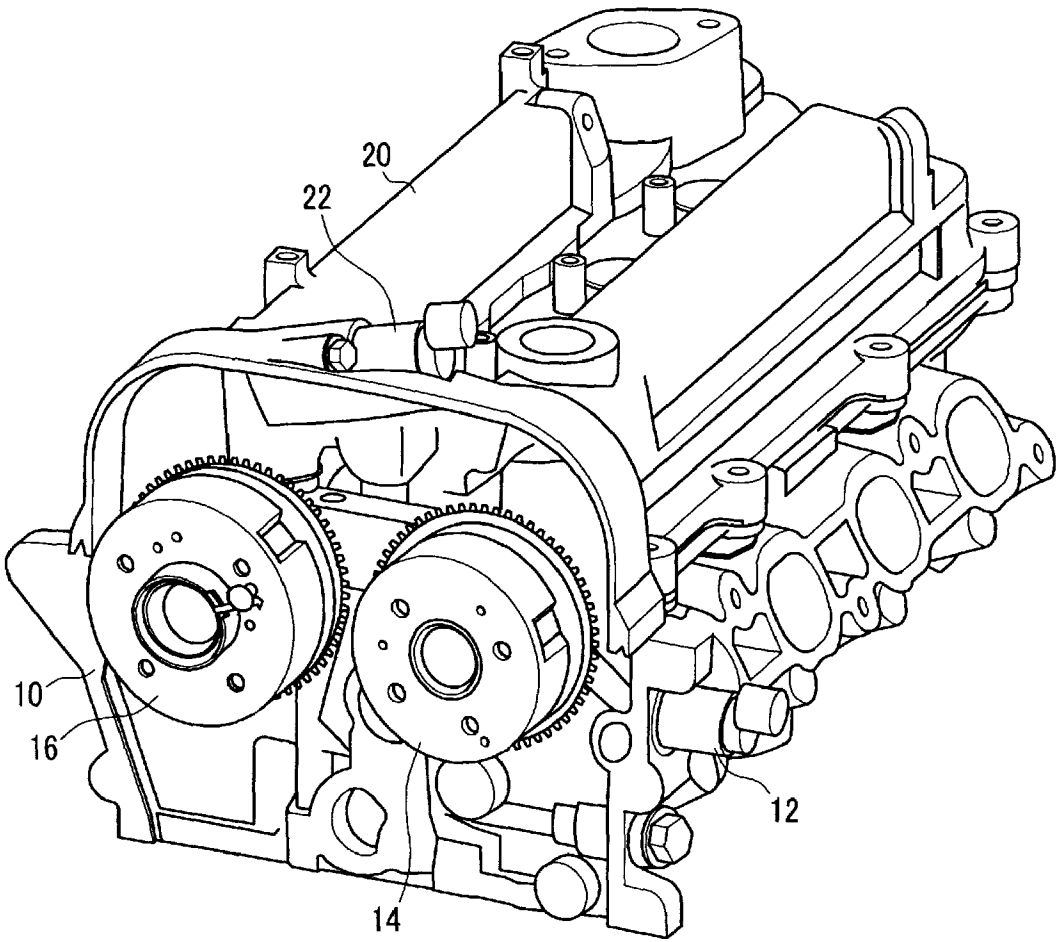
FIG. 1 is a partial perspective view of a cylinder head that is fitted with a continuously variable valve timing apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 2:
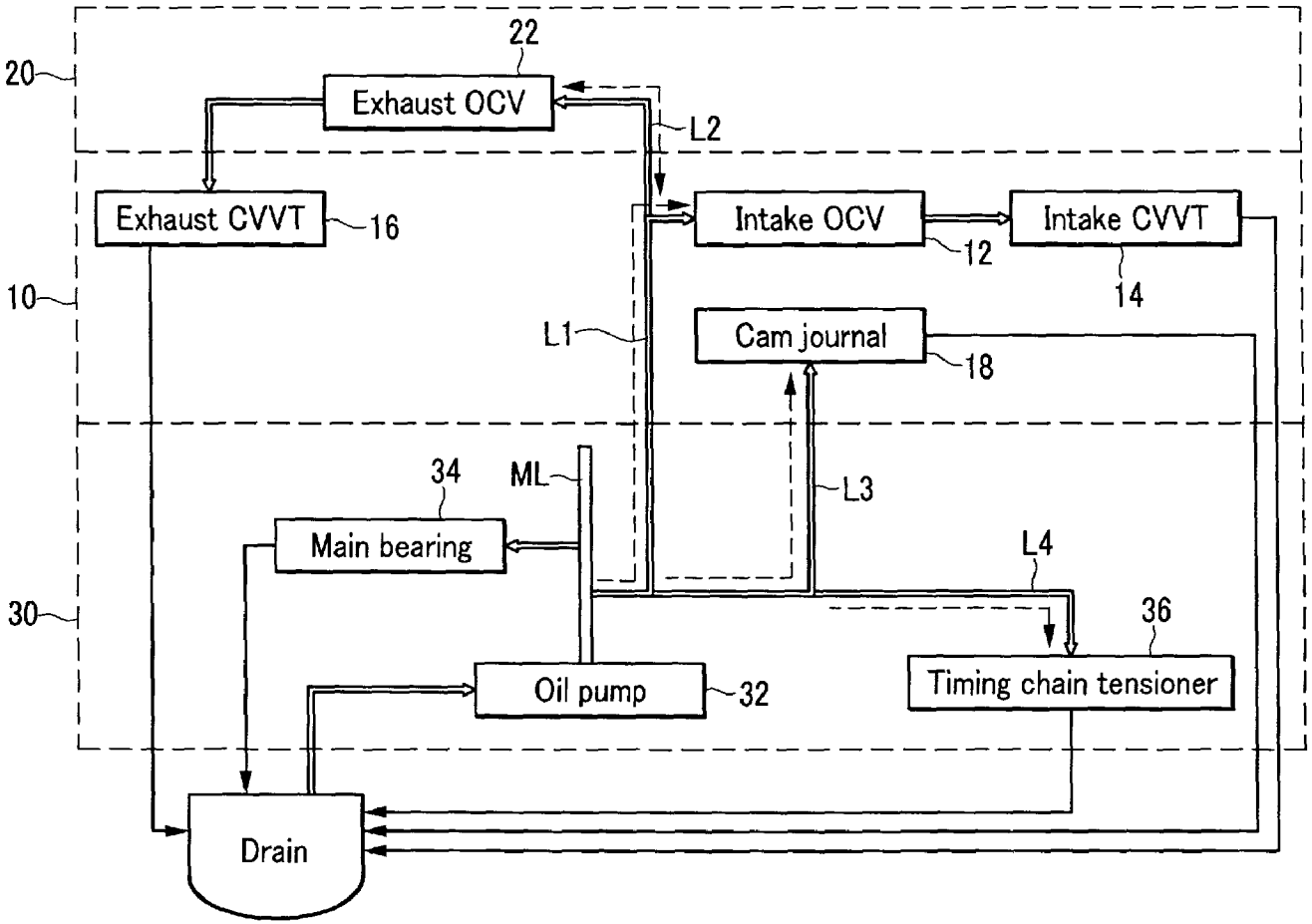
FIG. 2 is a schematic diagram showing an oil circuit for a continuously variable valve timing apparatus according to an exemplary embodiment of the present invention.

FIG. 1 is a partial perspective view of a cylinder head that is fitted with a continuously variable valve timing apparatus according to an exemplary embodiment of the present invention, and FIG. 2 is a schematic diagram showing an oil circuit for a continuously variable valve timing apparatus according to an exemplary embodiment of the present invention.

Referring to FIG. 1 and FIG. 2, the continuously variable valve timing apparatus is disposed at exhaust and intake parts. The oil circuit for a continuously variable valve timing apparatus according to an exemplary embodiment of the present invention can be applied in an engine that is fitted with a dual continuously variable valve timing apparatus that respectively controls the intake valve and the exhaust valve.

Also, the oil circuit for a continuously variable valve timing apparatus according to an exemplary embodiment of the present invention can be applied to an engine that is a gasoline direct injection type and includes the dual continuously variable valve timing apparatus (D-CVVT).

According to an exemplary embodiment of the present invention, the continuously variable valve timing apparatus receives hydraulic pressure that is transmitted from a hydraulic pump 32 of the engine. Further, an oil line is formed along a cylinder block 30, a cylinder head 10, and a cylinder head cover 20 so as to supply the continuously variable valve timing apparatus with oil from the hydraulic pump 32.

An intake oil control valve (12, intake OCV) and an exhaust oil control valve (22, exhaust OCV) are respectively disposed in the oil circuit for a continuously variable valve timing apparatus so as to control the oil that is respectively supplied to an intake continuously variable valve timing apparatus (14, intake CVVT) and an exhaust continuously variable valve timing apparatus (16, exhaust CVVT.)

For reference, the intake continuously variable valve timing apparatus 14 that receives the oil from the intake oil control valve 12 is mounted in the cylinder head 10. Further, the exhaust oil control valve 22 is mounted in the cylinder head cover that is assembled on the cylinder head 10.

The exhaust continuously variable valve timing apparatus 16 that receives the oil from the exhaust oil control valve 22 is mounted in the cylinder head 10. Accordingly, the exhaust oil line and the intake oil line are asymmetrically formed with respect to each other in an exemplary embodiment of the present invention.

While the dual continuously variable valve timing apparatus is operated to respectively control the intake valve and the exhaust valve, it needs to simultaneously move the intake valve and the exhaust valve without a timing difference. For this, the oil circuit for a continuously variable valve timing apparatus minimizes fluctuation of the hydraulic pressure.

Also, the tension of a timing chain (belt) that connects the camshaft with a crankshaft is appropriately controlled.

That is, for the proper operation of the dual continuously variable valve timing apparatus, the hydraulic pressure is to be equally supplied to the two camshafts such that abnormal operation according to the supply timing difference is prevented.

The tension of the timing chain is appropriately controlled during the operation of the dual continuously variable valve timing apparatus such that the crankshaft and the camshaft are interlocked to each other.

The oil circuit for a continuously variable valve timing apparatus according to an exemplary embodiment of the present invention includes a main line (ML), a first oil line L1, a second oil line L2, a third oil line L3, and a fourth oil line L4. The oil that is supplied to each line is returned to a drain, and the drained oil is recirculated to the lines by the hydraulic pump 32.

The main line (ML) is formed in the cylinder block 30 to receive the oil from the hydraulic pump 32. The main line (ML) is connected to a main bearing 34. A separate line can be connected to the main line (ML) so as to supply the related elements with oil according to the kind of engine.

For example, a turbocharger (T/C) can be mounted on a gasoline direct injection engine, and the oil line that is branched from the main line is extended to the turbocharger such that the oil of the main line can be transferred to the turbocharger.

However, the first oil line L1 is branched from the main line (ML) to be extended to the cylinder head 10 so as to ensure that the oil is supplied to the continuously variable valve timing apparatus.

The first oil line L1 connects the intake oil control valve 12 with the main line (ML). The intake oil control valve 12 is disposed on the cylinder head 10 that is assembled on the cylinder block 30. The intake continuously variable valve timing apparatus 14 that receives the oil from the intake oil control valve 12 is mounted in the cylinder head 10.

The second oil line L2 connects the exhaust oil control valve 22 with the first oil line L1. The exhaust oil control valve 22 is mounted on the cylinder head cover 20 that is assembled on the cylinder head 10. The exhaust continuously variable valve timing apparatus 16 that receives the oil from exhaust oil control valve 22 is mounted in the cylinder head 10.

As stated above, the exhaust continuously variable valve timing apparatus 16 is mounted in the cylinder head 10, and the exhaust oil control valve 22 is mounted in the cylinder head cover 20. Here, the cylinder head cover 20 is in a higher position than the cylinder head 10. Accordingly, the oil that is supplied from the exhaust oil control valve 22 to the exhaust continuously variable valve timing apparatus 16 flows from a high place to a low place.

As stated above, the oil that is supplied to the exhaust oil control valve 22 that is mounted in the cylinder head cover 20 through the second oil line L2 moves in a lower direction to be supplied to the exhaust continuously variable valve timing apparatus 16 of the cylinder head 10, that is, a top down oil line is formed.

The oil that is supplied to the exhaust oil control valve 22 that is mounted in the cylinder head cover 20 moves downwards to be transferred to the exhaust continuously variable valve timing apparatus 16 of the cylinder head 10 such that the oil is protected from the high temperature of the cylinder head, and the resistance of the oil pressure is minimized.

The third oil line L3 is branched from the first oil line L1 to be extended to a cam journal (also known as "camshaft journal") 18 that is mounted in the cylinder head 10.

The fourth oil line L4 is branched from the third oil line L3 to be extended to a timing chain tensioner 36 that is mounted in the cylinder block 30.

In the oil circuit for a continuously variable valve timing apparatus according to an exemplary embodiment of the present invention, the oil is firstly supplied to the cam journal 18 and then to the timing chain tensioner 36 through the third oil line L3 and the fourth oil line L4 from the first oil line L1.

That is, the third oil line L3 is diverged from the first oil line L1 to supply the cam journal with the oil, wherein the third oil line L3 is diverged from the first oil line L1 ahead of the fourth oil line L4 such that the oil flux can be securely confirmed.

Accordingly, the crankshaft and the camshaft are swiftly interlocked to transfer the driving torque thereof.

The tension force of the timing chain is controlled at an appropriate time, and the hydraulic pressure is continuously supplied at the operating timing of the intake oil control valve 12 and the exhaust oil control valve 22 such that rapid responsiveness and accurate functioning of the continuously variable valve timing apparatus can be secured. For convenience in explanation and accurate definition in the appended claims, the terms "up", "top", "downwards", "down" and "lower" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An oil circuit for a continuously variable valve timing apparatus, comprising:

a main line that is formed in a cylinder block to receive oil from a hydraulic pump;

a first oil line that connects an intake oil control valve that is mounted on a cylinder head that is assembled to the cylinder block with the main line;

a second oil line that connects an exhaust oil control valve that is mounted in a cylinder head cover with the first oil line;

a third oil line that connects a cam journal that is formed in the cylinder head with the first oil line; and a fourth oil line that connects a timing chain tensioner that is mounted in the cylinder block with the third oil line.

2. The oil circuit of claim 1, wherein an intake continuously variable valve timing apparatus is mounted on the cylinder head and receives the oil from the intake oil control valve.

3. The oil circuit of claim 1, wherein the second oil line is branched from the first oil line in the cylinder head.

4. The oil circuit of claim 1, wherein the third oil line is branched from the first oil line in the cylinder block.

5. The oil circuit of claim 3, wherein the fourth oil line is branched from the third line in the cylinder block.

6. The oil circuit of claim 5, wherein a distance between the main line and a branching point of the first and third oil lines is shorter than a distance between the main line and a branching point of the third and fourth oil lines.

7. The oil circuit of claim 1, wherein the fourth oil line is branched from the third line in the cylinder block.

8. The oil circuit of claim 1, wherein an exhaust continuously variable valve timing apparatus (exhaust CVVT) that receives the oil from the exhaust oil control valve is mounted on the cylinder head, and a top-down oil line is formed therebetween such that the oil is supplied from the exhaust oil control valve to the exhaust continuously variable valve timing apparatus through the second oil line.

9. The oil circuit of claim 1, wherein the oil is first supplied to the cam journal ahead of the timing chain tensioner through the third oil line from the first oil line.

10. The oil circuit of claim 1, wherein a distance between the cam journal and a branching point of the third and fourth oil lines is shorter than the fourth oil line such that the oil is first supplied to the cam journal ahead of the timing chain tensioner.

11. The oil circuit of claim 1, wherein a main bearing is connected to the main line in the cylinder block.

* * * * *